US012421732B2

(12) United States Patent
Steffes et al.

(10) Patent No.: US 12,421,732 B2
(45) Date of Patent: Sep. 23, 2025

(54) FLAT SIDING PANEL AND PANEL SIDING SYSTEM

(71) Applicant: CertainTeed LLC, Malvern, PA (US)

(72) Inventors: Stephen W. Steffes, McPherson, KS (US); Brian W. Kirn, Hatboro, PA (US)

(73) Assignee: CertainTeed LLC, Malvern, PA (US)

( * ) Notice: Subject to any disclaimer, the term of this patent is extended or adjusted under 35 U.S.C. 154(b) by 0 days.

(21) Appl. No.: 17/526,576

(22) Filed: Nov. 15, 2021

(65) Prior Publication Data

US 2022/0154473 A1 May 19, 2022

Related U.S. Application Data

(60) Provisional application No. 63/113,669, filed on Nov. 13, 2020.

(51) Int. Cl.
*E04F 13/08* (2006.01)
*E04F 13/18* (2006.01)

(52) U.S. Cl.
CPC ..... *E04F 13/0894* (2013.01); *E04F 13/18* (2013.01); *E04F 2201/0107* (2013.01); *E04F 2201/023* (2013.01); *E04F 2201/043* (2013.01)

(58) Field of Classification Search
CPC .. E04F 13/007; E04F 13/0864; E04D 1/2918; E04D 1/2907
See application file for complete search history.

(56) References Cited

U.S. PATENT DOCUMENTS 1,455,657 A * 5/1923 Pontello ..... E04D 3/04 52/518
2,735,143 A * 2/1956 Kearns ..... E04F 13/0864 52/553

(Continued)

FOREIGN PATENT DOCUMENTS

CA 1328725 C * 4/1994 ..... E04D 1/20
EP 1194663 B1 * 2/2005 ..... E04C 2/20

(Continued)

OTHER PUBLICATIONS

EP-1194663-B1 google translation (Year: 2005).*

(Continued)

*Primary Examiner* — Michael W Hotchkiss
(74) *Attorney, Agent, or Firm* — McDonnell Boehnen Hulbert & Berghoff LLP

(57) ABSTRACT

The present disclosure relates generally to cladding for covering a building surface. The present disclosure relates more particularly to flat siding panels that form a visible surface over a support structure. The siding panel includes a panel body having a front wall extending across the length and height of the panel body. Each of an upper wall, lower wall, first side wall, and second side wall extends rearward from the front wall along edges of the panel body. The panel body also includes a support projection disposed between the upper wall, lower wall, first side wall, and second wall and extending rearward from a rear surface of the front wall. A fastening strip is coupled to the upper wall of the panel body. An upper lock is disposed along a top edge of the panel body, and a lower lock is disposed along a bottom edge of the panel body.

14 Claims, 8 Drawing Sheets

(56) References Cited

U.S. PATENT DOCUMENTS 2,766,861 A * 10/1956 Abramson ..... E04F 13/0864 52/530
3,579,940 A * 5/1971 Greenleaf ..... E04D 1/2914 52/553
3,593,479 A * 7/1971 Hinds ..... B44F 9/02 D25/139
3,783,570 A * 1/1974 Storch ..... E04D 1/2918 52/553
3,835,609 A * 9/1974 Oscar ..... E04D 1/08 52/522
3,862,532 A * 1/1975 Markos ..... E04D 3/32 52/553
4,343,126 A * 8/1982 Hoofe, III ..... E04D 1/2916 52/555
5,060,444 A * 10/1991 Paquette ..... E04D 1/2918 52/526
5,537,792 A * 7/1996 Moliere ..... E04F 13/0864 52/546
5,671,577 A * 9/1997 Todd ..... E04D 1/12 52/302.1
5,836,128 A * 11/1998 Groh ..... E04F 15/10 52/775
6,035,588 A * 3/2000 Zehner ..... E04B 5/12 52/592.1
6,164,034 A * 12/2000 Roetheli ..... E04D 1/20 52/537
6,233,892 B1 * 5/2001 Tylman ..... E04D 3/366 52/794.1
7,395,634 B2 7/2008 Anderson
7,520,098 B1 * 4/2009 Martinique ..... E04D 1/34 52/553
8,572,921 B2 * 11/2013 Ward ..... E04D 1/20 52/518
8,590,270 B2 * 11/2013 Martinique ..... E04D 1/34 52/525
8,596,000 B2 * 12/2013 Mitchell ..... E04F 13/076 52/573.1
8,707,649 B2 * 4/2014 Wilkie ..... E04F 13/0835 52/533
8,713,861 B2 * 5/2014 Desloover ..... F24S 20/67 52/173.3
9,109,363 B2 * 8/2015 Grau ..... E04F 13/0894
9,169,652 B2 * 10/2015 Steffes ..... E04F 13/0801
9,267,296 B2 * 2/2016 Maurer ..... E04D 1/2916
9,416,540 B2 * 8/2016 Allen ..... E04D 1/20
9,518,391 B2 * 12/2016 Haynes ..... H02S 40/44
9,523,202 B2 * 12/2016 Anderson ..... E04D 3/30
9,605,432 B1 * 3/2017 Robbins ..... E04D 1/20
9,970,197 B2 * 5/2018 Maurer ..... E04F 13/0869
10,378,213 B2 * 8/2019 Hill ..... E04B 2/707
10,590,659 B2 * 3/2020 Santarossa ..... E04F 13/0876
10,850,440 B2 * 12/2020 Buckingham ..... E04D 1/22
11,384,542 B2 * 7/2022 DeRogatis ..... E04D 1/2914
2006/0261353 A1 11/2006 Bandoh
2007/0044416 A1 * 3/2007 Van Dijk ..... E04F 13/18 52/650.3
2008/0307738 A1 * 12/2008 Lorenzon ..... E04D 1/2916 52/521
2009/0056257 A1 3/2009 Mollinger
2009/0068406 A1 3/2009 Race
2009/0282764 A1 11/2009 Hendricks
2009/0313934 A1 * 12/2009 Carlson ..... E04F 13/0864 52/518
2010/0058691 A1 * 3/2010 Mannion ..... E04F 13/0864 52/287.1
2010/0088988 A1 * 4/2010 Gaudreau ..... E04F 13/0864 52/522
2010/0170182 A1 * 7/2010 Gately ..... E04F 13/0801 52/520
2011/0047894 A1 * 3/2011 Shadwell ..... E04D 1/20 52/518
2011/0061323 A1 * 3/2011 Schwarz ..... E04F 13/0864 52/520
2012/0017525 A1 * 1/2012 Knapp ..... E04F 15/105 52/302.1
2012/0297697 A1 * 11/2012 Schaefer ..... E04F 13/09 52/302.1
2014/0174015 A1 * 6/2014 Gaudreau ..... E04F 13/0837 52/745.21
2015/0298374 A1 10/2015 Steffes
2015/0354217 A1 * 12/2015 Lucas ..... E04D 1/30 52/747.1
2015/0354224 A1 * 12/2015 Maurer ..... E04D 1/12 52/302.1
2016/0010342 A1 1/2016 Steffes
2016/0340909 A1 * 11/2016 Riebel ..... E04F 13/0846
2017/0234019 A1 * 8/2017 Culpepper ..... B32B 27/286 52/539
2018/0056559 A1 3/2018 Shaw
2019/0169857 A1 6/2019 Steffes
2019/0203477 A1 * 7/2019 Hill ..... E04B 9/225
2019/0301173 A1 10/2019 Steffes
2019/0301175 A1 10/2019 Steffes
2019/0301178 A1 * 10/2019 Steffes ..... E04F 13/185
2020/0318353 A1 * 10/2020 DeRogatis ..... E04D 1/2949
2020/0385995 A1 * 12/2020 Hill ..... E04B 1/40
2021/0301542 A1 9/2021 Steffes
2021/0332595 A1 * 10/2021 MacPherson ..... E04F 13/0894

FOREIGN PATENT DOCUMENTS

FR 2589504 A1 * 5/1987
GB 2497569 A * 6/2013 ..... B29C 44/188

OTHER PUBLICATIONS

EP-1194663-B1 annotated Figures 1-3 ('Figure B') (Year: 2005).*
FR2589504A1 translation (Year: 1987).*
Extrutech Plastics, Inc., "Item # P1600, P1600 16" Inch, Flat, Interlocking Wall and Ceiling Liner Panel," copyright 2019.
Trespa, "Trespa(R) Meteon(R) Available with PEFC(TM) or FSC(TM) Certification," Apr. 2019.

* cited by examiner

FLAT SIDING PANEL AND PANEL SIDING SYSTEM

CROSS-REFERENCE TO RELATED APPLICATIONS

This application claims the benefit of priority of U.S. Provisional Patent Application No. 63/113,669, filed Nov. 13, 2020, which is hereby incorporated herein by reference in its entirety.

BACKGROUND OF THE DISCLOSURE

1. Field of the Disclosure

The present disclosure relates generally to cladding for covering a building surface. The present disclosure relates more particularly to flat siding panels configured to form a visible surface over a support structure.

2. Technical Background

Building surface panels, such as cladding or siding, are visible elements that cover an underlying support structure. The panels can provide protection of the support structure and also form the visible facade of the wall or other building surface. Siding panels are typically configured to be attached directly to the support structure, for example, using mechanical fasteners, adhesive, or another attachment method. In addition, siding panels often interconnect to one another, which strengthens the structural integrity of the surface and the overall connection of the panels to the support structure.

Siding panels come in various different shapes to allow for many different aesthetic options. For example, manufactured siding products can have many different profiles including clapboard, dutchlap, beaded, board and batten, shake siding, or shingle siding. Although there are a variety of different siding profile options, most of the foregoing profiles represent overlapping planks of wood. Accordingly, siding is very recognizable, and most siding provides a similar overall aesthetic, despite the variations in the siding profile.

The present inventors have recognized that siding panels with an alternative design would be attractive to builders and customers by allowing for a greater variety of surface aesthetics.

SUMMARY OF THE DISCLOSURE

In one aspect, the present disclosure provides a siding panel comprising:

- a panel body having a length extending from a first end to a second end and a height extend from a top edge to a bottom edge, the panel body comprising:
  - a front wall extending across the length and height of the panel body and including a front surface and a rear surface,
  - an upper wall extending rearward from the front wall across the top edge,
  - a lower wall extending rearward from the front wall across the bottom edge,
  - a first side wall extending rearward from the front wall along the first end,
  - a second side wall extending rearward from the front wall along the second end, and

- a support projection disposed between the upper wall, lower wall, first side wall, and second wall and extending rearward from the rear surface of the front wall;
- a fastening strip coupled to the upper wall of the panel body;
- an upper lock disposed along the top edge of the panel body; and
- a lower lock disposed along the bottom edge of the panel body.

In another aspect, the disclosure provides a building surface siding system comprising:

- a support structure;
- a first siding panel according to the disclosure attached to the support structure; and
- a second siding panel according to the disclosure attached to the support structure, wherein the upper lock of the first siding panel is coupled to the lower lock of the second siding panel.

Additional aspects of the disclosure will be evident from the disclosure herein.

BRIEF DESCRIPTION OF THE DRAWINGS

The accompanying drawings are included to provide a further understanding of the methods and devices of the disclosure, and are incorporated in and constitute a part of this specification. The drawings are not necessarily to scale, and sizes of various elements may be distorted for clarity. The drawings illustrate one or more embodiment(s) of the disclosure, and together with the description serve to explain the principles and operation of the disclosure.

DETAILED DESCRIPTION

As described above, the present inventors have noted that conventional siding systems have several recognizable profile shapes with various consistencies. The present inventors have determined that siding panels including an alternative design would be attractive to builders and customers.

Accordingly, one aspect of the disclosure is a siding panel that includes a panel body having a length extending from a first end to a second end and a height extend from a top edge to a bottom edge. The panel body includes a front wall that extends across the length and height of the panel body and has a front surface and a rear surface. The panel body also includes an upper wall that extends rearward from the front wall across the top edge and a lower wall that extends rearward from the front wall across the bottom edge. Likewise, a first side wall extends rearward from the front wall along the first end of the panel body, and a second side wall extends rearward from the front wall along the second end of the panel body. The panel body also includes a support projection disposed between the upper wall, lower wall, first side wall, and second wall that extends rearward from the rear surface of the front wall. The siding panel also includes a fastening strip coupled to the upper wall of the panel body, an upper lock disposed along the top edge of the panel body, and a lower lock disposed along the bottom edge of the panel body.

Figure 1:
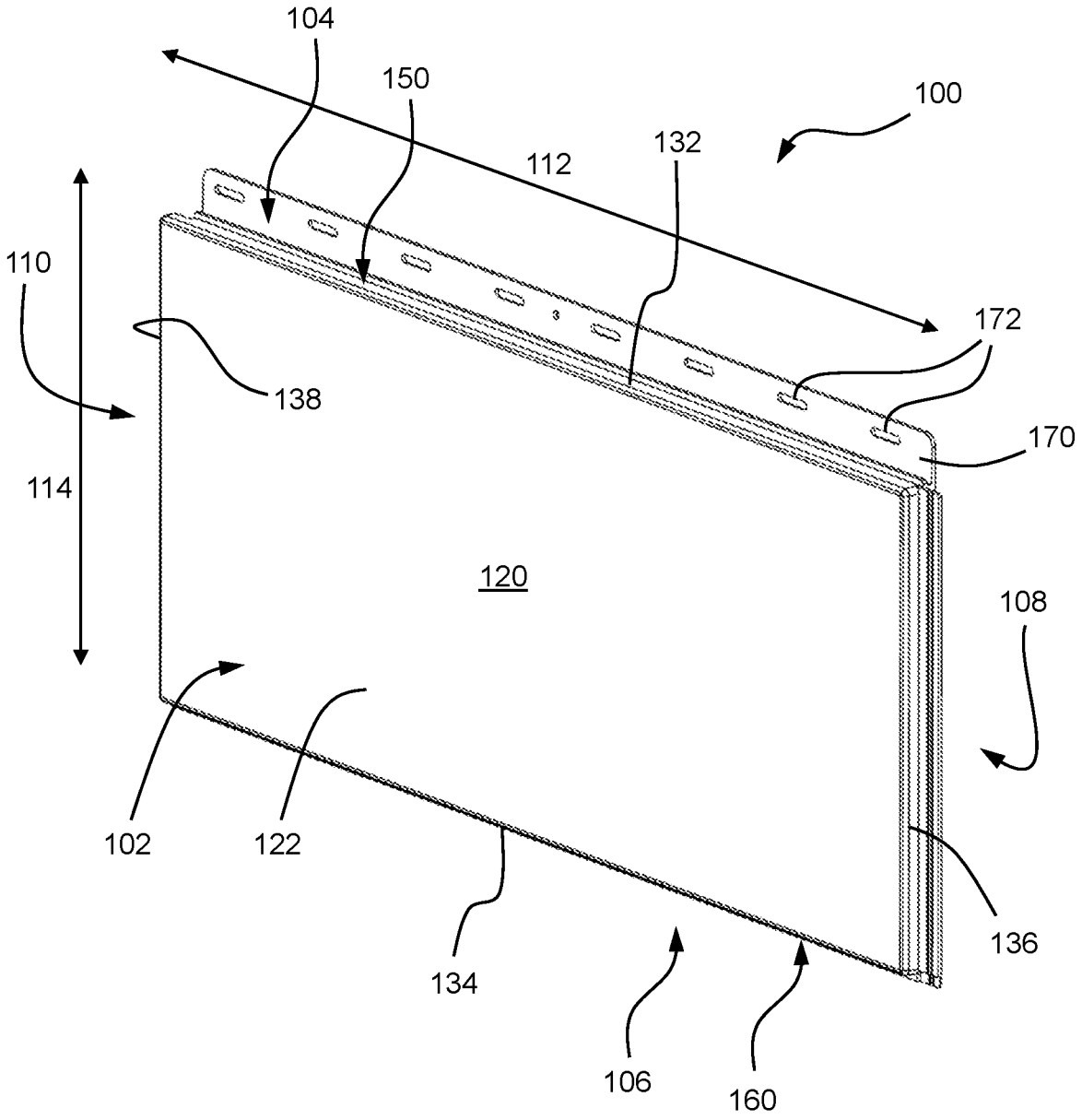
FIG. 1 is a schematic front perspective view of a siding panel according to an embodiment of the disclosure.
Figure 2:
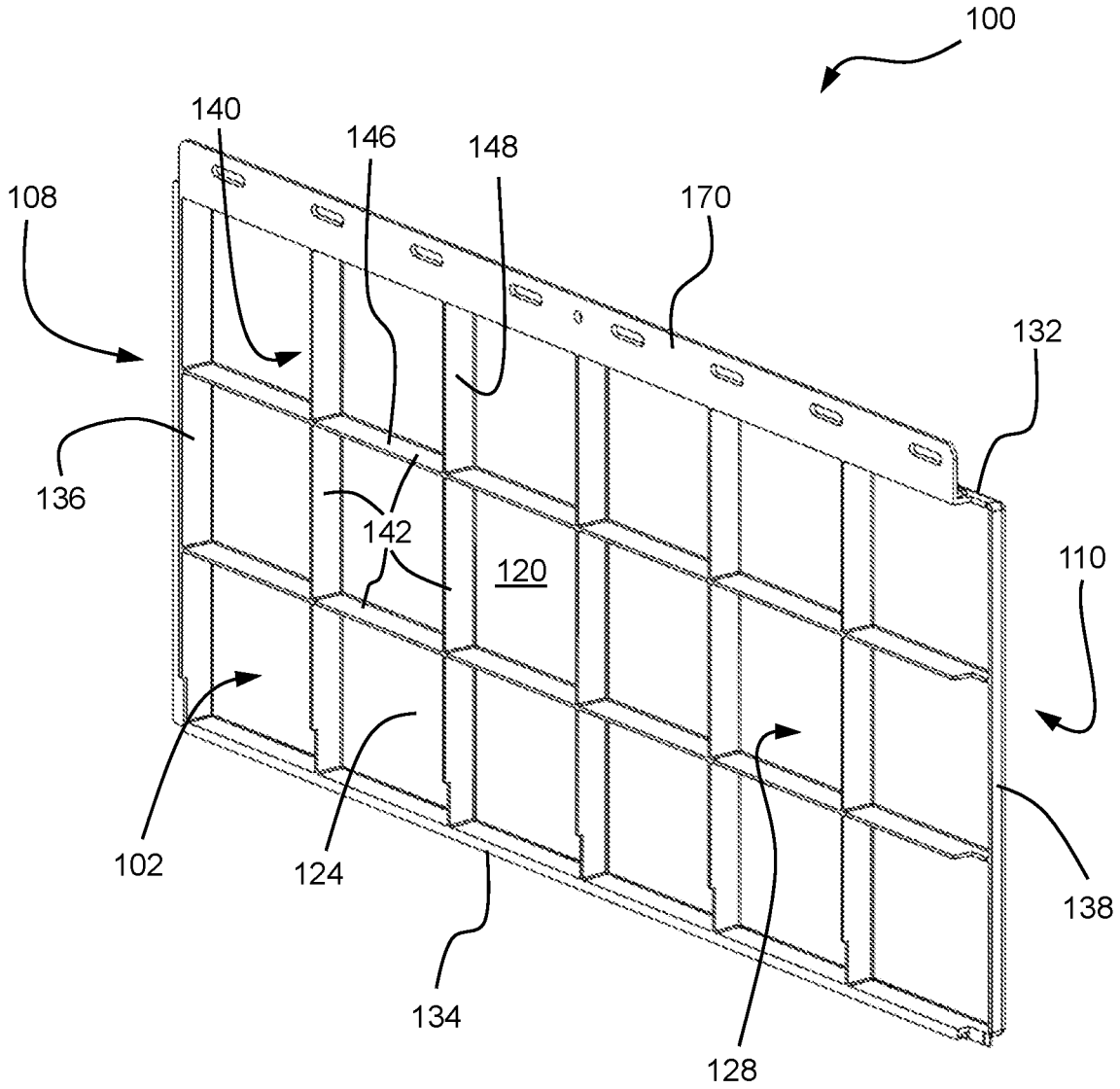
FIG. 2 is a schematic rear perspective view of the siding panel of FIG. 1.

Such a siding panel is shown in a front perspective view in FIG. 1 and a rear perspective view in FIG. 2. Siding panel 100 includes a panel body 102 with a top edge 104, a bottom edge 106, a first end 108, and a second end 110. The length 112 of panel body 102 extends from first end 108 to second end 110 and the height 114 extends from top edge 104 to bottom edge 106. Panel body 100 is formed by a plurality of walls including front wall 120 that extends across length 112 and height 114 of panel body 102. The front wall 120 includes a front surface 122 and a rear surface 124. Front surface 122 is configured to be the visible surface of panel body 102.

The walls that form panel body 100 also include an upper wall 132 that extends rearward from rear surface 124 along top edge 104 of panel body 102 and a lower wall 134 that extends rearward from rear surface 124 along bottom edge 106 of panel body 102. Likewise, a first side wall 136 extends rearward from rear surface 124 of front wall 120 along first end 108, and a second side wall 138 also extends rearward from rear surface 124 of front wall 120 along second end 110. Panel body 102 also includes a support projection 140 disposed between upper wall 132, lower wall 134, first side wall 136, and second wall 138. Support projection 140 extends rearward from rear surface 124 of the front wall 120 and provides structural stability to the broad surface of front wall 120 of panel body 102. Furthermore, in some embodiments, support projection 140 also acts as a brace for front wall 120, holding front wall 120 at a distance from an underlying support structure, as explained in more detail below.

Siding panel 100 also includes a fastening strip 170 that is coupled to upper wall 132 of panel body 102 and is configured to secure siding panel 100 to an underlying support structure, as explained in more detail below. Siding panel 100 also includes an upper lock 150 disposed along top edge 104 of panel body 102, and a lower lock 160 disposed along bottom edge 106 of panel body 102. Upper lock 150 and lower lock 160 are configured to secure siding panel 100 to other siding panels of a similar configuration that are positioned above and below siding panel 100. Accordingly, the configuration of upper lock 150 is constructed to cooperate with a lock of another siding panel having the same configuration as lower lock 160. Likewise, lower lock 160 is configured to cooperate with a lock of another siding panel having the same configuration as upper lock 150.

In certain embodiments of the siding panel as otherwise described herein, each of the first and second side walls is connected to the upper wall and the lower wall so as to form a continuous wall structure that surrounds a hollow space behind the front wall of the panel body. For example, as shown in FIG. 2, first side wall 136 is connected to upper wall 132 and lower wall 134 along first end 108, while second side wall 138 is also connected to upper wall 132 and lower wall 134 along second end 110. As a result, upper wall 132, first side wall 136, lower wall 134 and second side wall 138 form a continuous wall structure that surrounds a hollow space 128 behind front wall 120. Thus, panel body 102 is in the form of a hollow shell that is open on the rear side. In other embodiments, the panel body 102 has another configuration. For example, in some embodiments, the upper wall, lower wall and side walls do not form a continuous structure. For instance, in some embodiments, the ends of the side walls are spaced from the upper and lower walls.

In certain embodiments of the siding panel as otherwise described herein, the front surface of the front wall includes a horizontal flat portion between the upper wall and lower wall that extends from the first side wall to the second side wall. Further, in certain embodiments, the front surface of the front wall includes a vertical flat portion between the first side wall and the second side wall that extends from the upper wall to the lower wall. Moreover, in certain embodiments, the entire front surface of the front wall is flat. For example, in siding panel 100, the entire front surface 122 of front wall 120, both along the entire length 112 from first end 108 to second end 110 as well as over the entire height 114 from top edge 104, is flat. The term flat, as used herein, refers to the roughness of the surface, where a flat surface is smooth and free of marked bumps or indentations. Thus, the flat front surface of the front wall may have some curvature but still be "flat" as that term is used herein. Further, in some embodiments, the front wall may be substantially planar, such as having a curvature of no more than 5 degrees, for example, no more than 3 degrees.

In other embodiments, the front surface of the front wall has a horizontal flat portion extending from the first end to the second end of the panel body, but also includes some variations in texture. For example, in some embodiments, the front surface of the front wall includes flat horizontal strips that are separated by grooves. Likewise, in some embodiments, the front surface of the front wall includes a vertical flat portion that extends from the top edge to the bottom edge. For example, in some embodiments, the front surface of the front wall includes flat vertical strips that are separated by grooves. Further, in some embodiments, the front surface of the front wall is not flat and includes a texture. For example, in some embodiments the front surface includes a substantially randomized rough texture. In other embodiments the front surface of the front wall includes a repeating texture, such as grooves, bumps, or a pattern.

Figure 3:
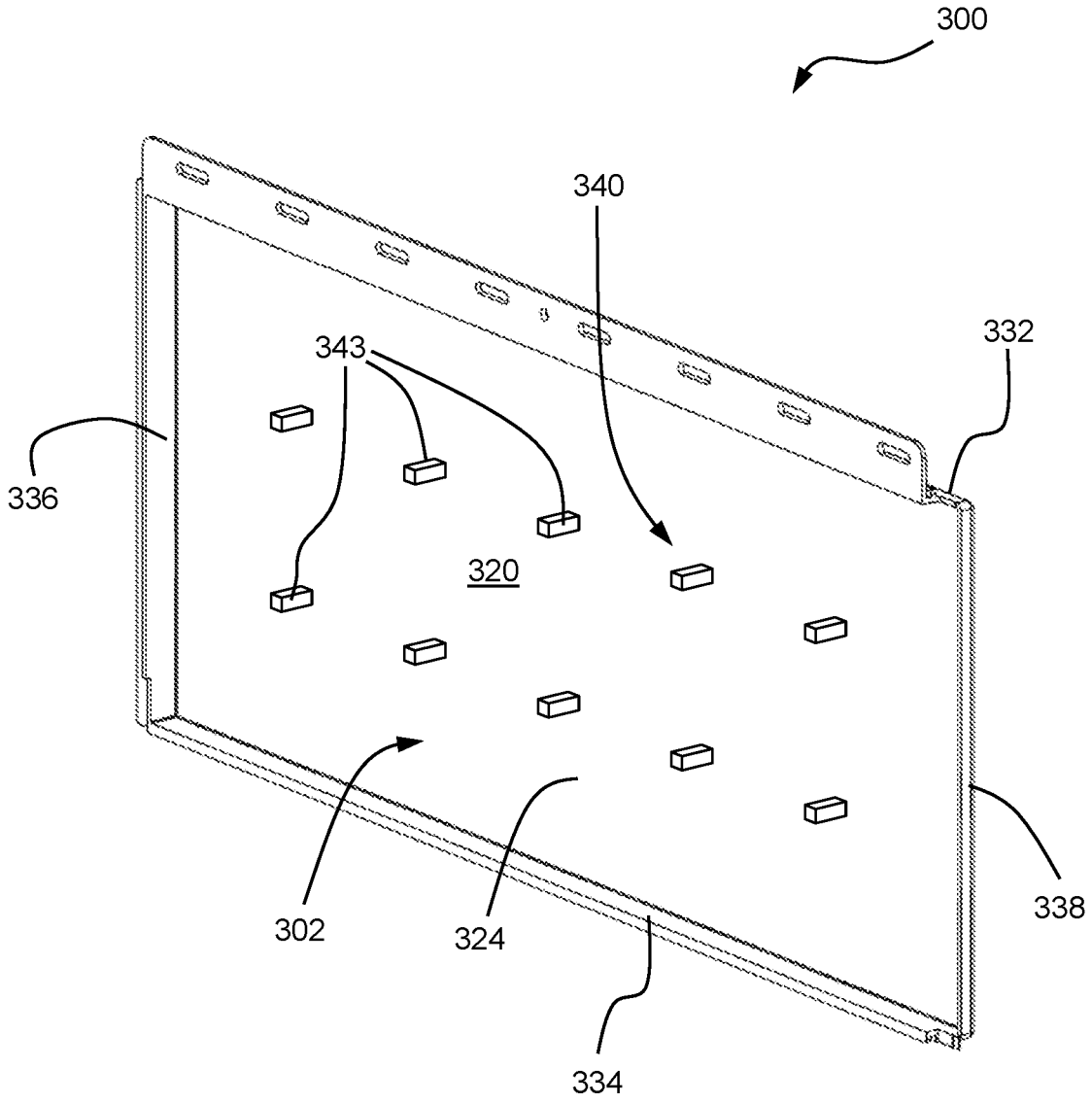
FIG. 3 is a schematic rear perspective view of a siding panel according to another embodiment of the disclosure.

In certain embodiments of the siding panel as otherwise described herein, the support projection includes a first flange that extends across at least a portion of the rear surface of the front wall. For example, the support projection 140 of panel body 102 includes a plurality of flanges 142 that extend across portions of the rear surface 124 of front wall 120. The flanges 142 project outward from rear surface 124 and have the configuration of a wall or linear projection. In other embodiments, the support projection has another form. For example, in some embodiments, the support projection is provided by one or more isolated projections. Such an embodiment is shown in FIG. 3. Siding panel 300 includes a panel body 302 with a front wall 320, an upper wall 332, a lower wall 334, and first and second side walls 336, 338, similar to siding panel 100. Panel body 302 also includes a support projection 340 that extends rearward from the rear surface 324 of front wall 320. The support projection 340 is formed as a plurality of discrete projections 343 that are spaced apart and extend rearward individually.

In certain embodiments of the siding panel as otherwise described herein, the first flange is free of an unattached end. For example, in siding panel 100, the support projection 140 is formed by a plurality of flanges 142 that extend across the entire rear surface 122 of front wall 120. Accordingly, each of the ends of the flanges 142 is coupled to a respective one of the upper wall 132, lower wall 134, first side wall 136 or second side wall 138. Accordingly, the support projection 140 does not include, or is free of, any flanges that have unattached ends. Such an unattached end, for example where the flange ends abruptly in the middle of the panel body, can cause stress points during manufacturing and may also be less durable and vulnerable to breaking. Therefore, a panel body, such as panel body 102, can provide structural advantages over a panel body with flanges that end abruptly. On the other hand, in some embodiments, design constraints and other factors may dictate a support projection design that includes unattached ends.

Figure 4:
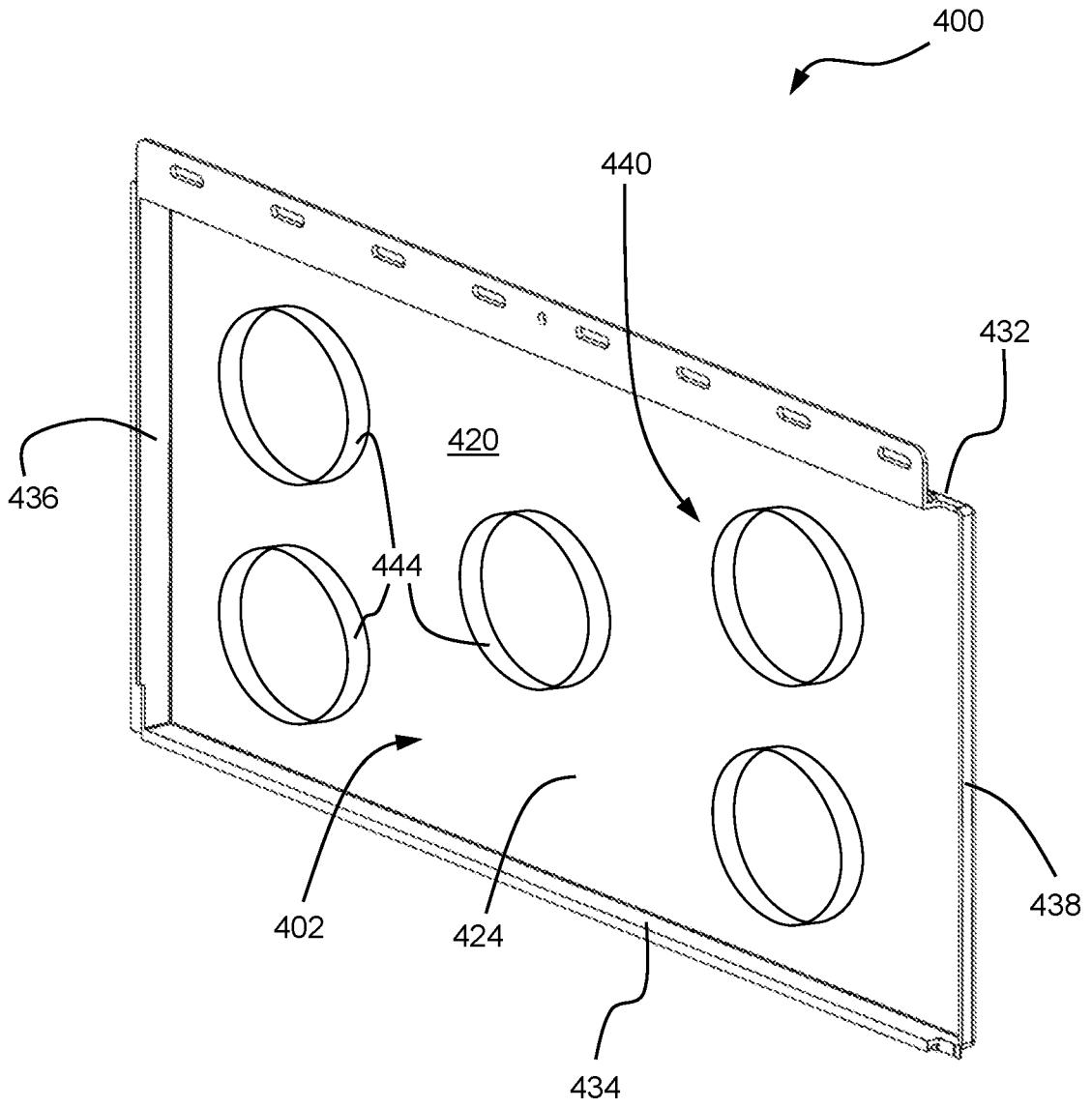
FIG. 4 is a schematic rear perspective view of a siding panel according to yet another embodiment of the disclosure.

While the support projection 140 of panel body 102 includes flanges 142 that connect to the outer walls 132 to 138 so as to avoided an unattached end, in other embodiments, the support projections 140 may include flanges that avoid an unattached end by another design. For example, such an embodiment is shown in FIG. 4. Siding panel 400 includes a panel body 402 with a front wall 420, an upper wall 432, a lower wall 434, and first and second side walls 436, 438. Panel body 402 also includes a support projection 440 that extends rearward from the rear surface 424 of front wall 420. Support projection 440 includes a group of flanges 444, each of which extends in a closed loop about a portion of the rear surface 424 of front wall 420. In particular, the flanges 444 are formed five rings dispersed over the rear surface 424. The closed loop configuration of flanges 444 prevents them from having any unattached ends without connecting to the surrounding walls 432 to 438 of the panel body 402. In other embodiments, the support projection includes a portion of flanges that form closed loops and a portion of flanges that connect to the surrounding walls.

In certain embodiments of the siding panel as otherwise described herein, the first flange extends across the length of the panel body from the first side wall to the second side wall. For example, the flanges 142 of support projection 140 of panel body 102 include a first flange 924 that extends from the first side wall 136 to the second side wall 138 traversing the entire length 112 of panel body 102. Further, support projection 140 also includes several other flanges that also extend along the length of panel body 102.

In certain embodiments of the siding panel as otherwise described herein, the support projection includes a second flange that extends across the height of the panel body from the upper wall to the lower wall. For example, the support projection 140 of panel body 102 includes a second flange 148 that extends from the upper wall 132 to the lower wall 134 traversing the entire height 114 of panel body 102. Further, support projection 140 also includes a number of other flanges that also extend across the height of panel body 102.

In some embodiments, the support projection includes flanges that extend in more than one direction. In other embodiments, the support projection includes flanges that only extend in one direction. For example, in some embodiments, the first flange extends along the length of the panel body and the support projection does not include any flanges that extend across the height of the panel body. Likewise, in certain embodiments of the siding panel as otherwise described herein, the first flange extends across the height of the panel body from the upper wall to the lower wall. For example, in some embodiments, the panel body includes one or more flanges that extend over the height of the panel body and does not include any flanges that extend along the length of the panel body.

In certain embodiments of the siding panel as otherwise described herein, the support projection includes a grid formed by a plurality of flanges extending across the rear surface of the front wall in at least two directions. For example, the support projection 140 of panel body 102 includes a grid of flanges 142 that extend in two directions across the rear surface 124 of front wall 120. In some embodiments, the grid is oriented similarly to the direction of the outer walls of the panel body, such as in panel body 102, wherein the flanges 142 run parallel and perpendicular to the upper wall, 132, lower wall 134, first side wall 136 and second side wall 138. In other embodiments the flanges are angled with respect to the walls of the panel body. Further, in some embodiments the flanges of the grid are perpendicular to one another, such as the flanges 142 of support projection 140 of panel body 102, thereby forming rectangles across the rear surface 124 of the front wall 120. In other embodiments, the flanges of the support projection grid are oriented to form diamonds, triangles or other shapes.

Figure 5:
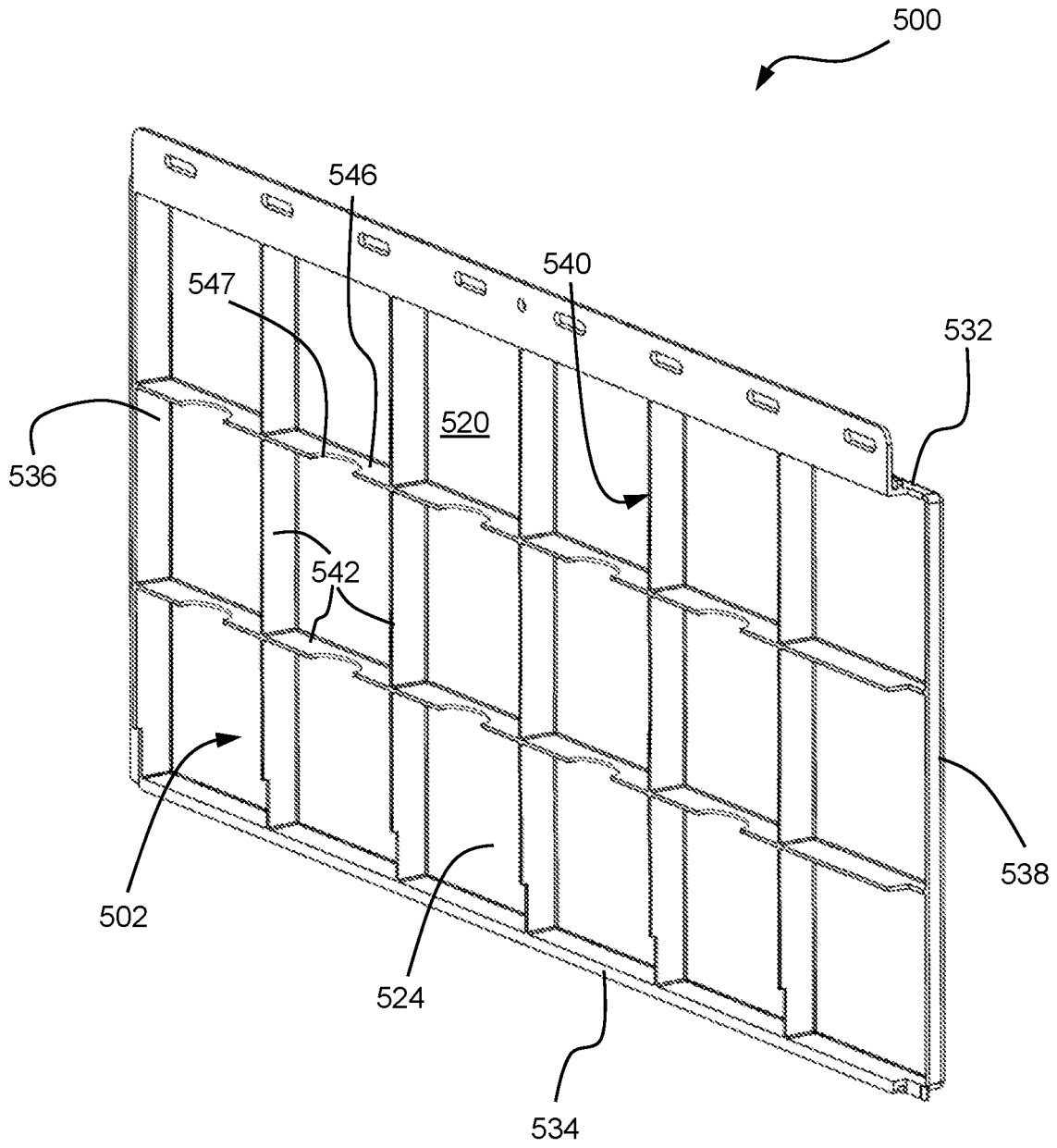
FIG. 5 is a schematic rear perspective view of a siding panel according to another embodiment of the disclosure.

In certain embodiments of the siding panel as otherwise described herein, the support projection includes a passage configured to allow water to cross the support projection. For example, in some embodiments, the support projection includes a flange that extends across the length of the panel body, and the flange includes a passage that allows water to flow past the support projection. Such a siding panel is shown in FIG. 5. Siding panel 500 includes a panel body 502 with a front wall 520, an upper wall 532, a lower wall 534, and first and second side walls 536, 538. Panel body 502 also includes a support projection 540 that extends rearward from the rear surface 524 of front wall 520. Similar to siding panel 100, support projection 540 includes a plurality of flanges 542 arranged in a grid, where the flanges 542 extend along the length and across the height of the panel body 502. To avoid trapping water in the grid, the first flange 546 extending along the length of panel body 502 includes a notch 547 that acts as a passage for water. In other embodiments, the passage is formed as a through hole. Still in other embodiments, the passage is formed by an undulating outer edge of the flange.

While the illustrated embodiments of siding panels of the disclosure have a greater length than height, in other embodiments, the height of the siding panel is larger than the length. Moreover, while the siding panels are described herein in connection with an installation where the fastening strip is placed at the top of the panel, the siding panels according to the disclosure can be installed in any orientation. Thus, while the siding panels of the disclosure are described as having an upper wall and a height, for example, it should be understood that these descriptors are used only with respect to relative positions of features on the siding panel while the panel is not attached to a fixed structure. Accordingly, the siding panels can be installed with the upper wall being vertical and aligned with gravity or at an angle with respect to gravity. Indeed, the siding panels of the disclosure may even be installed with the upper wall disposed at the bottom.

Figure 6A:
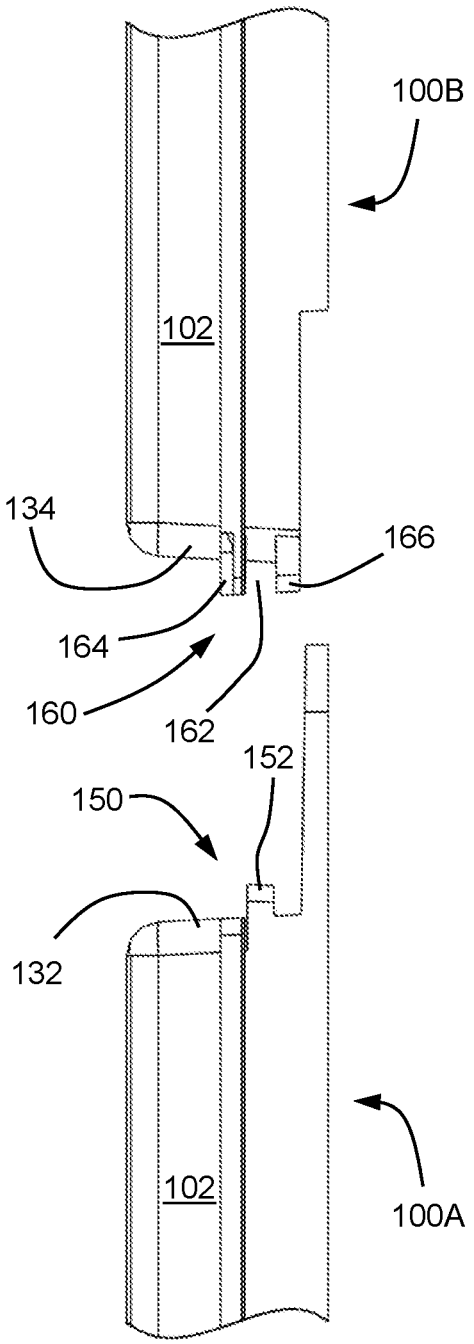
FIG. 6A is a schematic side elevation view of a pair of siding panels according to an embodiment of the disclosure in a first position.
Figure 6B:
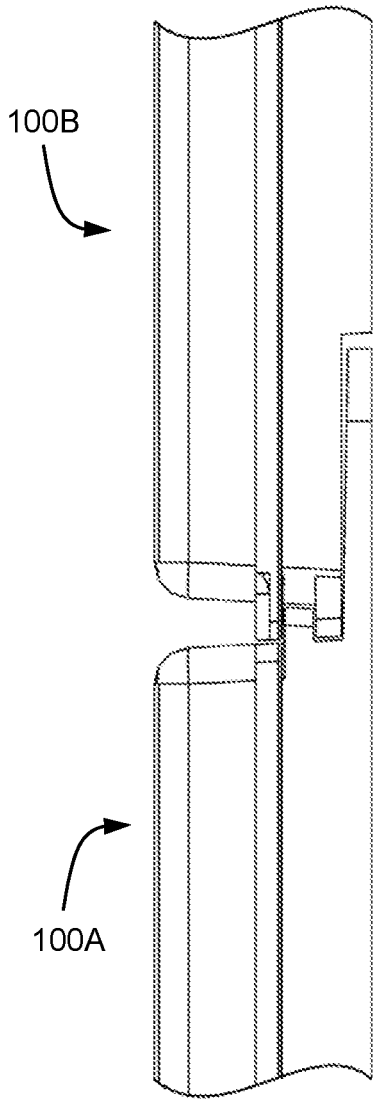
FIG. 6B is a schematic side elevation view of the siding panels of FIG. 6A in a second position.

In certain embodiments of the siding panel as otherwise described herein, the upper lock includes a lip and the lower lock includes a slot. For example, in siding panel 100, upper lock 150 includes a lip and lower lock 160 includes a slot configured to receive the lip of an upper lock having the same configuration as that of siding panel 100. For example, FIGS. 6A and B show a lower portion of a siding panel 100A and an upper portion of a siding panel 100B, each of siding panels 100A and 100B have the same configuration as siding panel 100, shown in FIGS. 1 and 2. As shown in FIGS. 6A and 6B, the upper lock 150 includes a lip 152 and the lower lock 160 includes a slot 162 that is configured to receive the lip 152. As shown in FIG. 6B, lip 152 fits into slot 162 to secure the two siding panels 100A and 100B together along their lower and upper sides, respectively.

As a result, in some embodiments, when two siding panels are coupled above and below one another, the lower siding panel can entirely support the upper siding panel, with the connection between the upper lock of the lower siding panel and the lower lock of the upper siding panel holding the upper siding panel in place. The lip of the upper lock secures the upper siding panel by supporting the upper siding panel on either side of the slot. Accordingly, to install an upper siding panel, the upper siding panel may simply be placed on top of the lower siding panel with the slot of the lower lock positioned to receive the lip of the upper lock of the lower siding panel. The upper siding panel can then be secured in place by attaching the top of the upper siding panel to a support structure using the fastening strip.

The use of lip 152 on upper lock 150 helps avoid water infiltration through a surface formed by the siding panels of the disclosure. At the interface where upper and lower siding panels meet, the lip is on the lower siding panel and projecting upward, as shown by siding panel 100B in FIG. 6B. Accordingly, any water that runs under the lower wall 134 of panel body 102 will be blocked from passing to the rear side of the siding panel by lip 152. In order to penetrate the siding, the water needs to flow up and over the lip, which is unlikely. In other embodiments, however, the upper lock includes a lip and the lower lock includes a slot. Still in some embodiments, the upper and lower locks each include both a lip and a slot. Moreover, in some embodiments, the upper and lower locks include sections of lips and slots. Further still, in some embodiments, the upper and lower locks have other configurations.

In certain embodiments of the siding panel as otherwise described herein, the lip extends continuously along the length of the panel body. For example, lip 152 of upper lock 150 extends across the entire upper wall 132 of siding panel 100. In other embodiments, the lip extends continuously along a majority of the length of the panel body, for example, extending from near the first side wall to near the second sidewall but not extending the full length of the siding panel. Further, in some embodiments, the lip is formed in sections. For example, in some embodiments, the lip is formed of two or more sections that are separated by gaps along the length of the siding panel. Such a construction can reduce the material needed to form the upper lock.

In some embodiments, the configuration of the locks as including a lip that fits into a slot allows lateral movement of the siding panels with respect to one another. Accordingly, there is some flexibility between the siding panels, which allows them to move with respect to one another, for example, as a result of thermal expansion and contraction.

In certain embodiments of the siding panel as otherwise described herein, the slot is formed by an elongate front projection that extends from the bottom edge of the panel body and an elongate rear projection that extends from the bottom edge of the panel body and runs parallel to the elongate rear projection so as to provide a gap between the elongate front projection and elongate rear projection that forms the slot. For example, as shown in FIG. 6B, the lower lock 160 of siding panel 100A is formed by an elongate front projection 164 and an elongate rear projection 166. The front projection 164 and rear projection 166 run parallel to one another and form a gap therebetween. The gap between the front projection 164 and rear projection 166 forms the slot 162 that is configured to receive the lip 152 of lower lock 160. Each of the front projection 164 and rear projection 166 extend from the bottom edge 106 of panel body 102. In particular, each of front projection 164 and rear projection 166 extend downward from lower wall 134 of panel body 102.

In certain embodiments of the siding panel as otherwise described herein, each of the elongate front projection and elongate rear projection extends continuously along the length of the panel body. For example, front projection 164 and rear projection 166 of lower lock 160 each extends across the entire lower wall 134 of siding panel 100. In other embodiments, the front projection extends across the entire length of siding panel and the rear projection does not. Likewise, in some embodiments, the rear projection extends across the entire length of the siding panel while the front projection does not. Further, in some embodiments, one or both of the front projection and rear projection extends continuously along a majority of the length of the panel body, for example, extending from near the first side wall to near the second sidewall but not extending the full length of the siding panel. Further, in some embodiments, the one or both of the front projection and rear projection is formed in sections. For example, in some embodiments, the front projection is formed of two or more sections that are separated by gaps along the length of the siding panel. Likewise, in some embodiments, the rear projection is formed of two or more sections that are separated by gaps along the length of the siding panel.

Likewise, in certain embodiments of the siding panel as otherwise described herein, each of the upper wall and lower wall extends continuously along the length of the panel body. Similarly, in certain embodiments of the siding panel as otherwise described herein, each of the first side wall and the second side wall extends continuously over the height of the panel body. The description of the walls as "extending continuously" over the length or height of the panel body, as used herein, refers to an uninterrupted surface that is free of gaps or holes where water may penetrate the siding panel body. In other embodiments, one or more of the walls includes gaps or openings, which reduces the weight of the siding panel.

In certain embodiments of the siding panel as otherwise described herein, the fastening strip is formed as a plate that extends upward from a rear side of the upper wall of the panel body. For example, fastening strip 170 of siding panel 100 is in the form of a plate extending along the length of siding panel 100. Fastening strip 170 is coupled to the upper wall 132 of panel body 102. Specifically, fastening strip 170 extends upward from the rear side of upper wall 132. Accordingly, fastening strip 170 is configured to sit flush against a supporting structure when siding panel 100 is secured to the supporting structure.

In some embodiments, the fastening strip includes apertures or nail slots to receive mechanical fasteners that attach the siding panel to a support structure. For example, fastening strip 170 includes slotted apertures 172 positioned in a row along the length of siding panel 100. When siding panel 100 is secured to a support structure, one or more mechanical fasteners may be inserted through the slotted apertures 172 to hold the siding panel 100 against the support structure. In other embodiments, the fastening strip is free of any apertures, and mechanical fasteners are driven through the fastening strip. Further, in some embodiments, the fastening strip is used to secure the siding panel to a support structure using an adhesive or another method.

In certain embodiments of the siding panel as otherwise described herein, the depth of the upper wall is greater than the depth of the lower wall, such that a lower portion of the panel body is configured to overlap a fastening strip of a neighboring siding panel. For example, as shown in FIGS. 6A and 6B, the lower wall 134 of panel body 102 has a depth that is less than the depth of upper wall 132. The shorter depth of lower wall 134 provides a space between lower wall 134 and a support structure when the siding panel is attached to the support structure. This space between the lower wall 134 and the support structure allows the fastening strip of a neighboring siding panel to fit behind the lower wall. For example, as shown in FIG. 6B, the fastening strip 170 of the lower siding panel 100B is able to fit behind the lower wall 134 of the upper siding panel 100A.

Figure 7A:
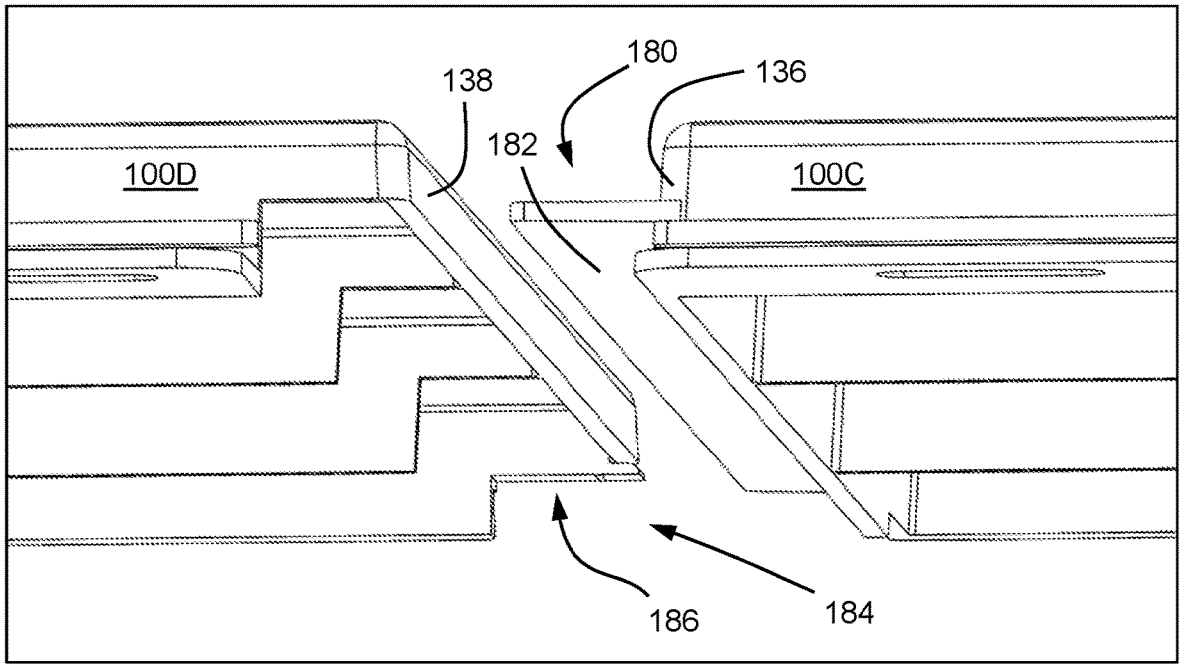
FIG. 7A is a schematic top perspective view of a pair of siding panels according to an embodiment of the disclosure in a first position.
Figure 7B:
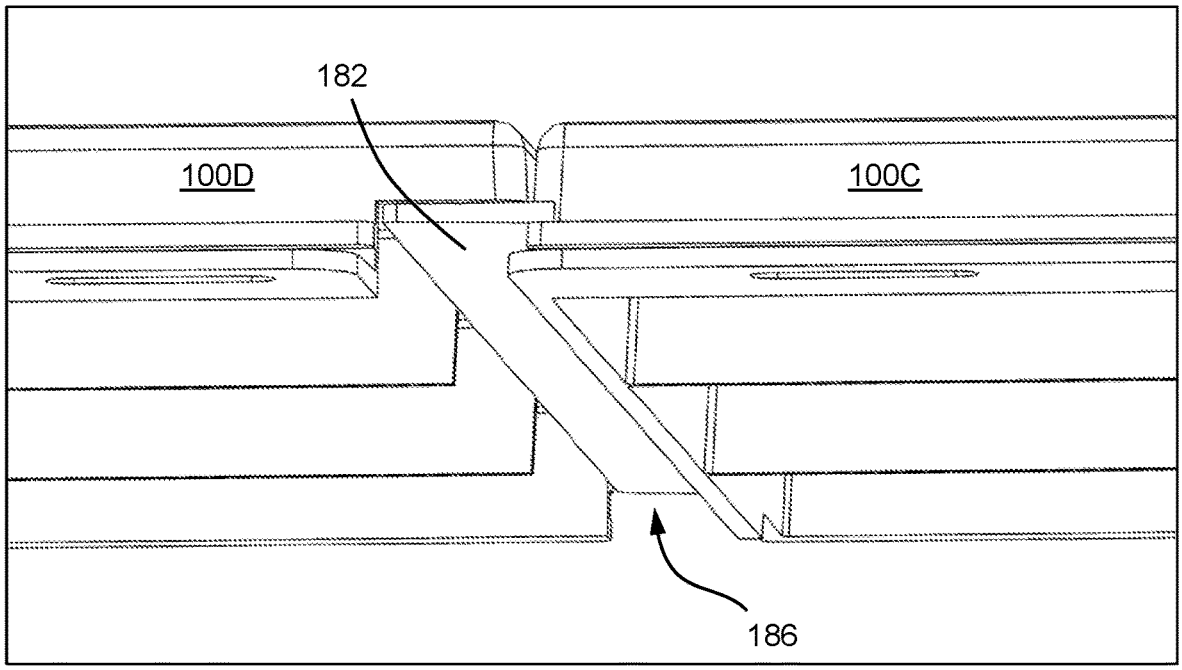
FIG. 7B is a schematic top perspective view of the siding panels of FIG. 7A in a second position.

In certain embodiments of the siding panel as otherwise described herein, the siding panel further includes a first side lock disposed along the first side wall and a second side lock disposed along the second side wall. For example, siding panel 100 includes a first side lock 180 disposed along the first side wall 136 at the first end 108 of panel body 102 and a second side lock 184 disposed along the second side wall 138 at the second end 110 of panel body 102. The first side lock 180 is configured to cooperate with a panel having side lock having the same configuration as second side lock 184. Likewise, second side lock 184 is configured to cooperate with a side lock having the same configuration as first side lock 180. For example, FIGS. 7A and 7B show a first side portion of a siding panel 100C and a second side portion of a siding panel 100D, each of siding panels 100C and 100D have the same configuration as siding panel 100, shown in FIGS. 1 and 2. As shown in FIGS. 7A and 7B, the first side lock 180 of siding panel 100C is configured to interact and cooperate with the second side lock 184 of siding panel 100D.

In certain embodiments of the siding panel as otherwise described herein, the first side lock includes a side flange that extends laterally outward from the first side wall, and the second side lock includes an opening configured to receive a side flange of a neighboring siding panel. For example, as shown in FIGS. 7A and 7B, the first side lock 180 of siding panel 100C includes a side flange 182 and the second side lock 184 of siding panel 100D includes an opening 186 that is configured to receive the side flange 182 of siding panel 100C. With the side flange 182 of first side lock 180 received in the opening 186 of second side lock 184, a portion of siding panel 100C overlaps with a portion of siding panel 100D, thereby forming a continuous surface when the siding panels are engaged.

In certain embodiments of the siding panel as otherwise described herein, the side flange is offset from the front side of the first side wall and is offset from the rear side of the first side wall. For example, side flange 182 is disposed on first side wall 136, between the front side and the rear side of first side wall 136, such that the side flange 182 is spaced from the front and rear of the siding panel. In other embodiments, the side flange is disposed in a different position. For example, in some embodiments, the side flange is disposed at the rear side of the siding panel.

In certain embodiments of the siding panel as otherwise described herein, the opening is disposed behind the rear side of the second side wall such that the second side wall is configured to overlap a side flange of a neighboring side panel. Further, in some embodiments, the depth of the first side wall is greater than the depth of the second side wall, such that a portion of the panel body along the second side wall to overlap a side flange of a neighboring siding panel. For example, as shown in FIGS. 7A and 7B, the depth of second side wall 138 is shallower than the depth of first side wall 136, such that second side wall 138 does not extend to the rear of siding panel 100. Accordingly, the opening 186 of second side lock 184 is formed by the open space behind second side wall 138 along the second end 110 of panel body 102. Thus, the second side wall 138 entirely overlaps the side flange 182 of first side lock 180. In other embodiments, the opening is provided as an aperture through the second side wall, and the side flange of the first side lock is configured to be inserted into the aperture. Still, in other embodiments, the opening is provided as a groove in the second side wall, and the side flange is configured to be held in the groove. Further, in other embodiments, the first and second side locks have another configuration.

In certain embodiments of the siding panel as otherwise described herein, the length of the panel body is at least 8 inches, e.g., at least 12 inches, e.g., at least 18 inches. Further, in certain embodiments of the siding panel as otherwise described herein, the length of the panel body is no more than 8 feet, e.g., no more than 6 feet, e.g., no more than 5 feet. For example, in some embodiments, the length of the panel body is in a range from 8 inches to 8 feet, e.g., from 12 inches to 6 feet, e.g., from 18 inches to 5 feet. For example, in some embodiments, the length of the panel body is in a range from 24 inches to 48 inches.

In certain embodiments of the siding panel as otherwise described herein, the height of the panel body is at least 3 inches, e.g., at least 4 inches, e.g., at least 6 inches. Further, in certain embodiments of the siding panel as otherwise described herein, the height of the panel body is no more than 4 feet, e.g., no more than 3 feet, e.g., no more than 2 feet. For example, in some embodiments, the height of the panel body is in a range from 3 inches to 4 feet, e.g., from 4 inches to 3 feet, e.g., from 6 inches to 2 feet. For example, in some embodiments, the height of the panel is in a range from 6 inches to 12 inches.

In certain embodiments of the siding panel as otherwise described herein, a depth of the panel body is at least ¼ inch, e.g., at least ⅜ inch, e.g., at least ½ inch. Further, in certain embodiments of the siding panel as otherwise described herein, a depth of the panel body is no more than 4 inches, e.g., no more than 3 inches, e.g., no more than 2 inches. For example, in some embodiments, the depth of the panel body is in a range from ¼ inch to 4 inches, e.g., from ⅜ inch to 3 inches, e.g., from ½ inch to 2 inches.

In certain embodiments of the siding panel as otherwise described herein, the panel body is formed of polymer. For example, the panel body includes at least one of polypropylene, polyethylene, polyvinyl chloride (PVC), acrylonitrile styrene acrylate (ASA), polyurethane, or acrylonitrile butadiene styrene (ABS).

Further, in some embodiments, the siding panels are polymer, in that the structure and shape of the panel is associated with a polymer construction, but the panels may include a large percentage of filler. For example, in some embodiments, the siding panel may include a polyurethane matrix but with a majority of filler (such as fly ash) and still be considered a "polymer panel," as will be appreciated by those of ordinary skill in the art. Likewise, in some embodiments the siding panel is largely formed of polymer but includes small sections that are made from another material, such as a metal. For example in some embodiments the fastening strip may include metal parts for stability.

In certain embodiments of the siding panel as otherwise described herein, the siding panel is formed as a single molded integral piece. For example, in some embodiments, the siding panel is injection molded. Further, in some embodiments, the siding panel is rotomolded, thermoformed, or cast. For example, in some embodiments the siding panel is formed of polyethylene and roto-molded. In some embodiments the siding panel is fabricated through an additive process. For example, in some embodiments the siding panel is made by 3D printing.

In certain embodiments as otherwise described herein, the siding panel includes a coating disposed over at least the front surface of the front wall. In some embodiments, the coating blocks ultraviolet (UV) light to protect the body of the panel from UV degradation. In some embodiments, the coating is decorative and imparts a particular visual aspect to the panel. For example, in some embodiments the coating is opaque and has a particular color. In other embodiments, the coating is transparent. In some embodiments, the coating is variegated, such that different portions of the surface of the panel have different colors. For example, in some embodiments, the coating is partially transparent such that sections of the underlying material of the panel body show through the coating while other sections are overlaid with an opaque covering.

In certain embodiments, the coating is applied directly to the front surface of the front wall of the panel body. In other embodiments, the coating is applied to the surface of a mold and is secured to the material of the panel during the molding process. In some embodiments, the coating is provided as a liquid that is sprayed or otherwise applied onto the panel body or into the mold. In other embodiments the coating is a film or laminate that is stretched over or otherwise applied to the panel body. Still, in other embodiments the film or laminate coating is inserted into a mold before the molding process.

In another aspect the disclosure provides a building surface siding system including a support structure, a first siding panel according to the disclosure attached to the support structure, and a second siding panel according to the disclosure attached to the support structure, where the lower lock of the first siding panel is coupled to the upper lock of the second siding panel.

Figure 8:
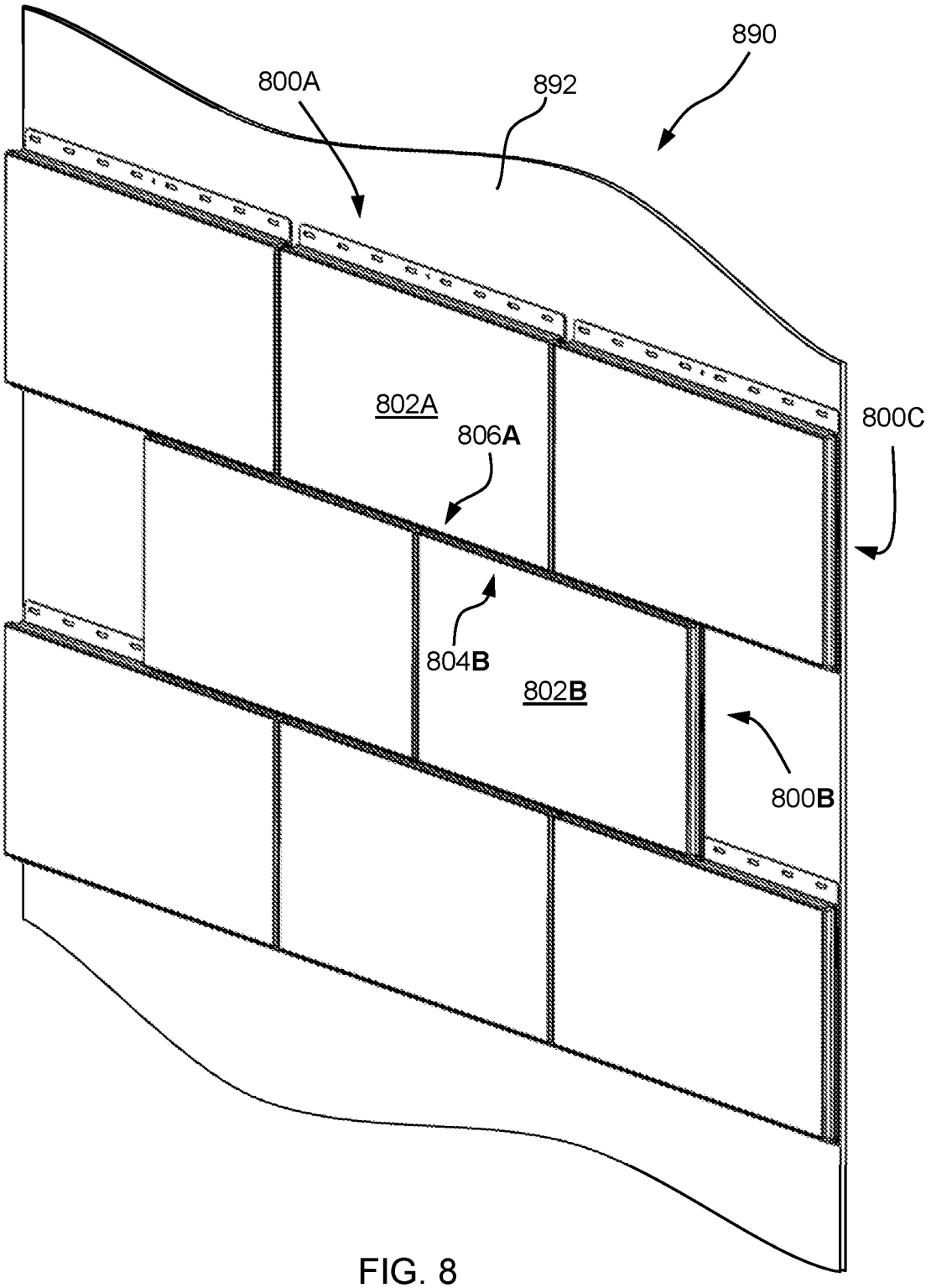
FIG. 8 is a schematic front perspective view of a building surface siding system according to an embodiment of the disclosure.

Such a building surface siding system is shown in FIG. 8. Building surface siding system 890 includes a support structure 892 and a plurality of siding panels 800A, 800B, 800C attached to support structure 892. The siding panels include a first siding panel 800A and a second siding panel 800B. A lower lock disposed along a bottom edge 806A of the panel body 802A of the first siding panel 800A is coupled to an upper lock disposed along the top edge 804B of the panel body 802B of second siding panel 800B In certain embodiments of the building surface siding system as otherwise described herein, the support projection of each siding panel rests against the support structure. For example, in some embodiments, each support projection extends rearward from the rear surface of the front wall of the panel body to the rear plane of the siding panel. Accordingly, when the siding panels are attached to the support structure, the respective support projections come into contact with the support structure. In other embodiments, the depth of support projection is smaller than the overall depth of the siding panel, such that the support projection is spaced from the support structure.

In certain embodiments of the building surface siding system as otherwise described herein, the upper lock of the first siding panel includes a lip and the lower lock of the second siding panel includes a slot that receives the lip of the first siding panel. For example, in certain embodiments, the siding panels include the configuration shown in FIGS. 6A and 6B of siding panels 100A and 100B. When mounted against the support structure, the lip of the upper lock of the lower siding panel is inserted into the slot of the lower lock of the upper siding panel.

In certain embodiments of the building surface siding system as otherwise described herein, the depth of the first siding panel is different from the depth of the second siding panel. For example, in some embodiments, the siding panels of the building surface siding system have different depths so that the siding panels project outward from the support structure to different degrees. Accordingly, such a building surface siding system forms a surface having a complex shape with siding panels at different elevations from the support structure. In other embodiments, all of the siding panels have the same depth. For example, in building surface siding system 890, the siding panels all have the same depth and form a substantially planar surface.

In certain embodiments of the building surface siding system as otherwise described herein, the length of the first siding panel is different from the length of the second siding panel. Likewise, in certain embodiments of the building surface siding system as otherwise described herein, the height of the first siding panel is different from the height of the second siding panel. For example, in some embodiments, the siding panels of the building surface siding system can vary in length and/or height to form a siding system with a non-uniform or varying pattern. In other embodiments, the length and height of each siding panel is the same. For example, in building surface siding system 890, each of the siding panels has the same length and height.

In certain embodiments of the building surface siding system as otherwise described herein, the first siding panel has a first color, and the second siding panel has a second color that is different from the first color. For example, in some embodiments, the siding panels of the building surface siding system can vary in color to create a desired aesthetic. For example, in some embodiments, the siding panels are provided in different shades of a common color, such as shades of grey or blue. In other embodiments, the siding panels vary dramatically in color, such as different primary or secondary colors. Further, in some embodiments, the color of the siding panels vary randomly across the building surface siding system. In other embodiments, the color of the siding panels varies in a predetermined way, such as gradually changing over the building surface or presenting a pattern.

In certain embodiments of the building surface siding system as otherwise described herein, the first end of the first siding panel is aligned with the first end of the second siding panel. In other embodiments, the first end of the first siding panel is offset from the first end of the second siding panel. For example, in some embodiments the siding panels of the siding system are arranged in a straight tile pattern, where the ends are all aligned. In other embodiments the siding panels are arranged in a brick pattern. For example, in building surface siding system 890, the ends of first siding panel 800A are offset from the ends of second siding panel 800B and the siding panels are arranged in a brick pattern.

In certain embodiments of the building surface siding system as otherwise described herein, the system further includes a third siding panel disposed adjacent to the first siding panel, such that the first end of the first siding panel is adjacent to the second end of the third siding panel. For example, building surface siding system 890 includes a third siding panel 800C that is disposed adjacent to first siding panel 800A, such that the first end of first siding panel 800A is adjacent to the second end of third siding panel 800C.

In certain embodiments of the building surface siding system as otherwise described herein, the first siding panel includes a first side lock that is coupled to a second side lock of the third siding panel. For example, in certain embodiments, the siding panels of the building surface siding system include the configuration shown in FIGS. 7A and 7B of siding panels 100C and 100D. When mounted against the support structure, the first side lock of the first panel is coupled to the second side lock of the third siding panel.

Additional aspects of the disclosure are provided by the following enumerated embodiments, which can be combined in any number and in any combination that is not technically or logically inconsistent.

Embodiment 1. A siding panel comprising:

a panel body having a length extending from a first end to a second end and a height extend from a top edge to a bottom edge, the panel body comprising:

a front wall extending across the length and height of the panel body and including a front surface and a rear surface, an upper wall extending rearward from the front wall across the top edge, a lower wall extending rearward from the front wall across the bottom edge, a first side wall extending rearward from the front wall along the first end, a second side wall extending rearward from the front wall along the second end, and a support projection disposed between the upper wall, lower wall, first side wall, and second wall and extending rearward from the rear surface of the front wall;

a fastening strip coupled to the upper wall of the panel body;

an upper lock disposed along the top edge of the panel body; and a lower lock disposed along the bottom edge of the panel body.

Embodiment 2. The siding panel according to embodiment 1, wherein each of the first and second side walls is connected to the upper wall and the lower wall so as to form a continuous wall structure that surrounds a hollow space behind the front wall of the panel body.

Embodiment 3. The siding panel according to embodiment 1 or embodiment 2, wherein the front surface of the front wall includes a horizontal flat portion between the upper wall and lower wall that extends from the first side wall to the second side wall.

Embodiment 4. The siding panel according to any of embodiments 1 to 3, wherein the front surface of the front wall includes a vertical flat portion between the first side wall and the second side wall that extends from the upper wall to the lower wall.

Embodiment 5. The siding panel according to any of embodiments 1 to 4, wherein the entire front surface of the front wall is flat.

Embodiment 6. The siding panel according to any of embodiments 1 to 5, wherein the support projection includes a first flange that extends across at least a portion of the rear surface of the front wall.

Embodiment 7. The siding panel according to embodiment 6, wherein the first flange is free of an unattached end.

Embodiment 8. The siding panel according to embodiment 6 or embodiment 7, wherein the first flange extends across the length of the panel body from the first side wall to the second side wall.

Embodiment 9. The siding panel according to embodiment 8, wherein the support projection includes a second flange that extends across the height of the panel body from the upper wall to the lower wall.

Embodiment 10. The siding panel according to embodiment 6 or embodiment 8, wherein the first flange extends across the height of the panel body from the upper wall to the lower wall.

Embodiment 11. The siding panel according to any of embodiments 1 to 10, wherein the support projection includes a grid formed by a plurality of flanges extending across the rear surface of the front wall in at least two directions.

Embodiment 12. The siding panel according to any of embodiments 1 to 11, wherein the support projection includes a passage configured to allow water to cross the support projection.

Embodiment 13. The siding panel according to any of embodiments 1 to 12, wherein the upper lock includes a lip and the lower lock includes a slot.

Embodiment 14. The siding panel according to embodiment 13, wherein the lip extends continuously along the length of the panel body.

Embodiment 15. The siding panel according to embodiment 13 or embodiment 14, wherein the slot is formed by an elongate front projection that extends from the bottom edge of the panel body and an elongate rear projection that extends from the bottom edge of the panel body and runs parallel to the elongate rear projection so as to provide a gap between the elongate front projection and elongate rear projection that forms the slot.

Embodiment 16. The siding panel according to embodiment 15, wherein each of the elongate front projection and elongate rear projection extends continuously along the length of the panel body.

Embodiment 17. The siding panel according to any of embodiments 1 to 16, wherein each of the upper wall and lower wall extends continuously along the length of the panel body.

Embodiment 18. The siding panel according to any of embodiments 1 to 17, wherein each of the first side wall and the second side wall extends continuously over the height of the panel body.

Embodiment 19. The siding panel according to any of embodiments 1 to 18, wherein the fastening strip is formed as a plate that extends upward from a rear side of the upper wall of the panel body.

Embodiment 20. The siding panel according to any of embodiments 1 to 19, wherein the depth of the upper wall is greater than the depth of the lower wall, such that a lower portion of the panel body is configured to overlap a fastening strip of a neighboring siding panel.

Embodiment 21. The siding panel according to any of embodiments 1 to 20, further comprising a first side lock disposed along the first side wall and a second side lock disposed along the second side wall.

Embodiment 22. The siding panel according to embodiment 21, wherein the first side lock includes a side flange that extends laterally outward from the first side wall, and wherein the second side lock includes an opening configured to receive a side flange of a neighboring siding panel.

Embodiment 23. The siding panel according to embodiment 22, wherein the side flange is offset from the front side of the first side wall and is offset from the rear side of the first side wall.

Embodiment 24. The siding panel according to embodiment 22 or embodiment 23, wherein the opening is disposed behind the rear side of the second side wall such that the second side wall is configured to overlap a side flange of a neighboring side panel.

Embodiment 25. The siding panel according to any of embodiments 1 to 24, wherein the depth of the first side wall is greater than the depth of the second side wall, such that a portion of the panel body along the second side wall to overlap a side flange of a neighboring siding panel.

Embodiment 26. The siding panel according to any of embodiments 1 to 25, wherein the length of the panel body is at least 8 inches, e.g., at least 12 inches, e.g., at least 18 inches.

Embodiment 27. The siding panel according to any of embodiments 1 to 26, wherein the length of the panel body is no more than 8 feet, e.g., no more than 6 feet, e.g., no more than 5 feet.

Embodiment 28. The siding panel according to any of embodiments 1 to 27, wherein the height of the panel body is at least 3 inches, e.g., at least 4 inches, e.g., at least 6 inches.

Embodiment 29. The siding panel according to any of embodiments 1 to 28, wherein the height of the panel body is no more than 4 feet, e.g., no more than 3 feet, e.g., no more than 2 feet.

Embodiment 30. The siding panel according to any of embodiments 1 to 29, wherein a depth of the panel body is at least ¼ inch, e.g., at least ⅜ inch, e.g., at least ½ inch.

Embodiment 31. The siding panel according to any of embodiments 1 to 31, wherein a depth of the panel body is no more than 4 inches, e.g., no more than 3 inches, e.g., no more than 2 inches.

Embodiment 32. The siding panel according to any of embodiments 1 to 31, wherein the panel body is formed of polymer.

Embodiment 33. The siding panel according to embodiment 32, wherein the panel body includes at least one of polypropylene, polyethylene, polyvinyl chloride (PVC), acrylonitrile styrene acrylate (ASA), polyurethane, or acrylonitrile butadiene styrene (ABS).

Embodiment 34. The siding panel according to any of embodiments 1 to 33, wherein the siding panel is formed as a single molded integral piece.

Embodiment 35. A building surface siding system comprising:

a support structure;

a first siding panel according to any of embodiments 1 to 34 attached to the support structure; and a second siding panel according to any of embodiments 1 to 34 attached to the support structure, wherein the lower lock of the first siding panel is coupled to the upper lock of the second siding panel.

Embodiment 36. The building surface siding system according to embodiment 35, wherein the support projection of each siding panel rests against the support structure.

Embodiment 37. The building surface siding system according to embodiment 35 or embodiment 36, wherein the lower lock of the first siding panel includes a slot and the upper lock of the second siding panel includes a lip that is received in the slot of the first siding panel.

Embodiment 38. The building surface siding system according to any of embodiments 35 to 37, wherein the depth of the first siding panel is different from the depth of the second siding panel.

Embodiment 39. The building surface siding system according to any of embodiments 35 to 38, wherein the length of the first siding panel is different from the length of the second siding panel.

Embodiment 40. The building surface siding system according to any of embodiments 35 to 39, wherein the height of the first siding panel is different from the height of the second siding panel.

Embodiment 41. The building surface siding system according to any of embodiments 35 to 40, wherein the first siding panel has a first color, and the second siding panel has a second color that is different from the first color.

Embodiment 42. The building surface siding system according to any of embodiments 35 to 41, wherein the first end of the first siding panel is aligned with the first end of the second siding panel.

Embodiment 43. The building surface siding system according to any of embodiments 35 to 42, further comprising a third siding panel disposed adjacent to the first siding panel, such that the first end of the first siding panel is adjacent to the second end of the third siding panel.

Embodiment 44. The building surface siding system according to embodiment 43, wherein the first siding panel includes a first side lock that is coupled to a second side lock of the third siding panel.

It will be apparent to those skilled in the art that various modifications and variations can be made to the processes and devices described here without departing from the scope of the disclosure. Thus, it is intended that the present disclosure cover such modifications and variations of this invention provided they come within the scope of the appended claims and their equivalents.

What is claimed is:

1. A building surface siding system comprising:

a substantially vertically-disposed support structure;

a first siding panel and a second siding panel each of the first siding panel and the second siding panel comprising:

a panel body having a length extending from a first end to a second end and a height extending from a top edge to a bottom edge, the panel body comprising:

a front wall extending across the length and height of the panel body and including a front surface and a rear surface, an upper wall extending rearward from the front wall across the top edge, the upper wall having a continuously linear rear surface extending from the first end of the panel body to adjacent the second end of the panel body, with a setback at the second end of the panel body, a lower wall extending rearward from the front wall across the bottom edge, the lower wall having a continuously linear rear surface extending from the first end to adjacent the second end, with a setback at the second end of the panel body, a first side wall extending rearward from the front wall along the first end, the first side wall having a continuously linear rear surface extending from the top edge of the panel body to adjacent the bottom edge of the panel body, with a setback at the bottom edge of the panel body, a second side wall extending rearward from the front wall along the second end, the second side wall having a continuously linear rear surface extending from the setback of the upper wall at the second end of the panel body to the setback of the lower wall at the second end of the panel body, each of the first and second side walls being connected to the upper wall and the lower wall so as to form a continuous wall structure that surrounds a hollow space behind the front wall of the panel body, the hollow space being exposed at a back side of the panel body and a support projection disposed between the upper wall, lower wall, first side wall, and second wall and extending rearward from the rear surface of the front wall and being exposed at the back side of the panel body, the support projection including a grid formed by a plurality of first flanges extending at least partially in a horizontal direction across the length of the panel body from the first side wall to the second side wall, and wherein each of the first flanges includes a passage selected from a notch, a through hole, and an undulation in an outer edge, configured to allow water to flow under the support projection in a vertical direction, the passages of the first flanges being horizontally aligned with one another, and a plurality of second flanges extending across the rear surface of the front wall at least partially in the vertical direction, wherein the depth of the upper wall is greater than the depth of the lower wall, such that a lower portion of the panel body is configured to overlap a fastening strip of a neighboring siding panel;

a fastening strip coupled to the upper wall of the panel body;

an upper lock disposed along the top edge of the panel body; and a lower lock disposed along the bottom edge of the panel body, wherein the first siding panel is attached to the support structure such that the front wall of the panel body of the first siding panel is disposed substantially vertically, the second siding panel is attached to the support structure such that the front wall of the panel body of the second siding panel is disposed substantially vertically, the lower lock of the first siding panel being coupled to the upper lock of the second siding panel, wherein the lower portion of the panel body of the first siding panel overlaps the fastening strip of the second siding panel, and the support projection of the first siding panel and the support projection of the second siding panel rest against the support structure.

2. The building surface siding system according to claim 1, wherein in each of the first siding panel and the second siding panel, the front surface of the front wall includes a horizontal flat portion between the upper wall and lower wall that extends from the first side wall to the second side wall.

3. The building surface siding system according to claim 1, wherein in each of the first siding panel and the second siding panel, the front surface of the front wall includes a vertical flat portion between the first side wall and the second side wall that extends from the upper wall to the lower wall.

4. The building surface siding system according to claim 1, wherein in each of the first siding panel and the second siding panel, the entire front surface of the front wall is flat.

5. The building surface siding system according to claim 1, wherein in each of the first siding panel and the second siding panel, each of the upper wall and lower wall extends continuously along the length of the panel body.

6. The building surface siding system according to claim 1, wherein in each of the first siding panel and the second siding panel, each of the first side wall and the second side wall extends continuously over the height of the panel body.

7. The building surface siding system according to claim 1, wherein in each of the first siding panel and the second siding panel, the fastening strip is formed as a plate that extends upward from a rear side of the upper wall of the panel body.

8. The building surface siding system according to claim 1, wherein each of the first siding panel and the second siding panel further comprises a first side lock disposed along the first side wall and a second side lock disposed along the second side wall, wherein the first side lock of the first siding panel is coupled to the second side lock of the second siding panel.

9. The building surface siding system according to claim 1, wherein the lower lock of the first siding panel includes a slot and the upper lock of the second siding panel includes a lip that is received in the slot of the first siding panel.

10. The building surface siding system according to claim 1, wherein the first siding panel and the second siding panel have a same depth, and form a substantially planar surface of the building surface siding system.

11. The building surface siding system according to claim 1, wherein in each of the first siding panel and the second siding panel, the upper lock includes a lip and the lower lock includes a slot.

12. The building surface siding system according to claim 11, wherein in each of the first siding panel and the second siding panel, the slot is formed by an elongate front projection that extends from the bottom edge of the panel body and an elongate rear projection that extends from the bottom edge of the panel body and runs parallel to the elongate front projection so as to provide a gap between the elongate front projection and elongate rear projection that forms the slot.

13. The building surface siding system according to claim 1, wherein in each of the first siding panel and the second siding panel, the first side lock includes a side flange that extends laterally outward from the first side wall, and wherein the second side lock includes an opening configured to receive a side flange of a neighboring siding panel, wherein the opening is disposed behind a rear side of the second side wall such that the second side wall is configured to overlap a side flange of a neighboring side panel, the second side wall terminating at the opening.

14. The building surface panel siding system of claim 13, wherein in each of the first siding panel and the second siding panel, the side flange is offset from the front side of the first side wall and is offset from the rear side of the first side wall.

* * * * *